US005931541A

United States Patent [19]

Pietrzyk et al.

[11] Patent Number: 5,931,541

[45] Date of Patent: Aug. 3, 1999

[54] DRIVE MECHANISM FOR A COMBINED CUTTER LOADER

[75] Inventors: Kazimierz Pietrzyk, Pszczyna; Józef Knyć, Katowice; Andrzej Błażewicz, Tychy; Konrad Wowro, Katowice, all of Poland

[73] Assignee: Fabryka Maszyn Gorniczych Famur Spolka Acyjna, Katowice, Poland

[21] Appl. No.: 08/833,078

[22] Filed: Apr. 3, 1997

[30] Foreign Application Priority Data

Jul. 30, 1996 [PL] Poland ..... 315477

[51] Int. Cl.[6] ..... E21C 29/22

[52] U.S. Cl. ..... 299/42; 299/53

[58] Field of Search ..... 299/42, 43, 53

[56] References Cited

U.S. PATENT DOCUMENTS

| | | | |
|---|---|---|---|
| 4,396,229 | 8/1983 | Stoppani | 299/53 |
| 4,465,319 | 8/1984 | Brownlie | 299/42 |
| 4,483,568 | 11/1984 | Schupphaus et al. | 299/53 |

*Primary Examiner*—David J. Bagnell
*Attorney, Agent, or Firm*—Ladas & Parry

[57] ABSTRACT

The subject of the invention is the drive mechanism especially of the combined cutter loader in which the indirect toothed wheel (4) is placed between the toothed wheel (3) and the drive wheel mechanism (5) and is mounted on axis (8), which is mounted in hubs (8) and (9), in which eccentric bushes (11) and (12) are found, whereas hub (9) and the eccentric bush (11) placed in it are mounted in housing of holder (1), and hub (10) and the eccentric bush (12) mounted in the housing (2) of holder (1).

6 Claims, 3 Drawing Sheets

DRIVE MECHANISM FOR A COMBINED CUTTER LOADER

FIELD OF THE INVENTION

The subject of the invention is the drive mechanism especially of the combined cutter loader, co-operating with the stiff bolt string as well as with the chain string.

BACKGROUND AND PRIOR ART

The drive mechanism especially of the combined cutter loader, comprising a drive toothed wheel with modular teeth which are mounted on the drive shaft of the combined cutter loader tractor, is known from the Polish patent application P.302296 The toothed drive wheel co-operates with the indirect modular toothed wheel with which the working wheel is connected in a separable manner, the teeth of which have a shape facilitating its co-operation with the stiff or elastic bolt string. The working wheel is mounted on the same axis as the indirect wheel, contacts the indirect wheel with its side surface and is connected with it in a separable manner.

The axis, on which the indirect wheel and the working wheel are mounted, is located in the holder and is mounted in the holder cover in a separable manner.

A drive mechanism comprising a toothed drive wheel and intermeshed indirect wheel which co-operates with the driving ladder mounted on conveyor gates, is known from the Polish patent application P.2999098. The indirect wheel is mounted on the axis in the closed housing, the housing being mounted in a separable manner on the combined cutter loader tractor body. Along the axis on which the indirect wheel is mounted, an opening is made, in which the screw for additional fixing of the housing and housing cover is located with the aid of a nut and insert placed in the housing cover. The locating of the indirect wheel axis in the housing is fixed.

A lubricating nipple is mounted in the fixing screw, from which grease is delivered through channels to the bearings on which the indirect wheel is mounted.

The combined cutter loader tractor body has a support mounted on it, carrying a runner leading the combined cutter loader along the driving edge of the mining conveyor.

From the presented state of the prior art the construction of a drive mechanism of combined cutter loaders working in stringless drive systems with stiff bolt string or chain string is known in which drive mechanism is fitted with a holder uniting the combined cutter loader tractor with the combined cutter loader sledge frame. Three toothed wheels or gears are mounted in the holder, and these comprise: toothed wheels with modular teeth placed on the drive shaft of the combined cutter loader tractor, indirect tooth wheel with modular teeth connected in a separable manner with drive wheel mounted on the same axis co-operating with a the conveyor route, or else the indirect tooth wheel with modular teeth co-operating with the above mentioned toothed wheels with the same module.

Such a construction of the drive mechanism imposes strictly defined parameters of forward velocity and maximum pulling force of the combined cutter loader, on the combined cutter loader.

A change of these parameters requires changing of the gear ratio of the toothed wheels of the drive mechanism.

In order to attain this effect it is necessary to exchange the modular toothed wheel mounted on the drive shaft of the combined cutter loader tractor, and of the modular toothed wheel connected in a separable manner with the drive wheel mounted on the same axis.

Realisation of the above exchange makes it necessary to change the distance between the axis of the rear wheels. As in the presented solutions, the axis of these wheels are stable, such an exchange is connected with the exchange of the whole holder, in which these wheels are mounted. In practice, such an operation is possible, but is very costly and time consuming.

SUMMARY OF THE INVENTION

An aspect of this invention is to elaborate the construction of the drive mechanism, which will ensure easy exchange of toothed wheels within the same holder, without the need of changing the holder.

This aspect has been achieved by the construction of the drive mechanism, which is composed of a modular toothed wheel mounted on the drive shaft, an indirect or intermediate modular tooth wheel and a modular wheel connected with the drive wheel, the axes of which are mounted in the holder. The holder is connected in a separable manner with the body of the combined cutter loader tractor and the sledge frame and is closed with a cover.

The indirect toothed wheel is placed between the toothed wheel mounted on the drive shaft of the combined cutter loader tractor and the drive wheel unit, comprising the modular toothed wheel and the drive wheel connected with said drive wheel directly co-operating with the course of the mining conveyor, and these wheels being connected in a separable manner.

The indirect toothed wheel is mounted on the axis placed in the holder. The axis of the indirect wheel on both sides is engaged in hubs, in which eccentric bushes are mounted, whereas one of the hubs together with the eccentric bush is mounted in the holder housing, and the second hub with the eccentric bush is mounted in the cover closing the holder.

Recesses are provided in flanges of each bush, with pins passed through them, and mounted in openings in the hub.

In the axis for the indirect modular toothed wheel, a longitudinal through opening is made, in which a screw is placed, which on one side passes through the opening in the cover closing the holder and is mounted in a grooved member gully secured in a socket in the closing cover, and on the other side is screwed into a nut, which is mounted in a socket in the holder housing.

There are at least two openings in the nut. The grooved member, in which the screw is placed from one side, is fitted in the socket in the cover in a separable manner.

The solution according to the invention allows free change of parameters of the combined cutter loader, such as: sliding velocity and pulling force in working conditions.

This is obtained by dismantling of the axis, with the indirect toothed wheel mounted on it, exchange of the co-operating toothed wheels and moving the axis of the indirect wheel into such a position, which will ensure proper meshing of the co-operating toothed wheels and protection of this axis against displacement. These operates are possible to carry out in working conditions and do not require exchange of any other technical means except for the toothed wheels.

BRIEF DESCRIPTION OF THE DRAWING

The subject of the invention is illustrated in the embodiment on the drawing, where.

DETAILED DESCRIPTION

Figure 1:
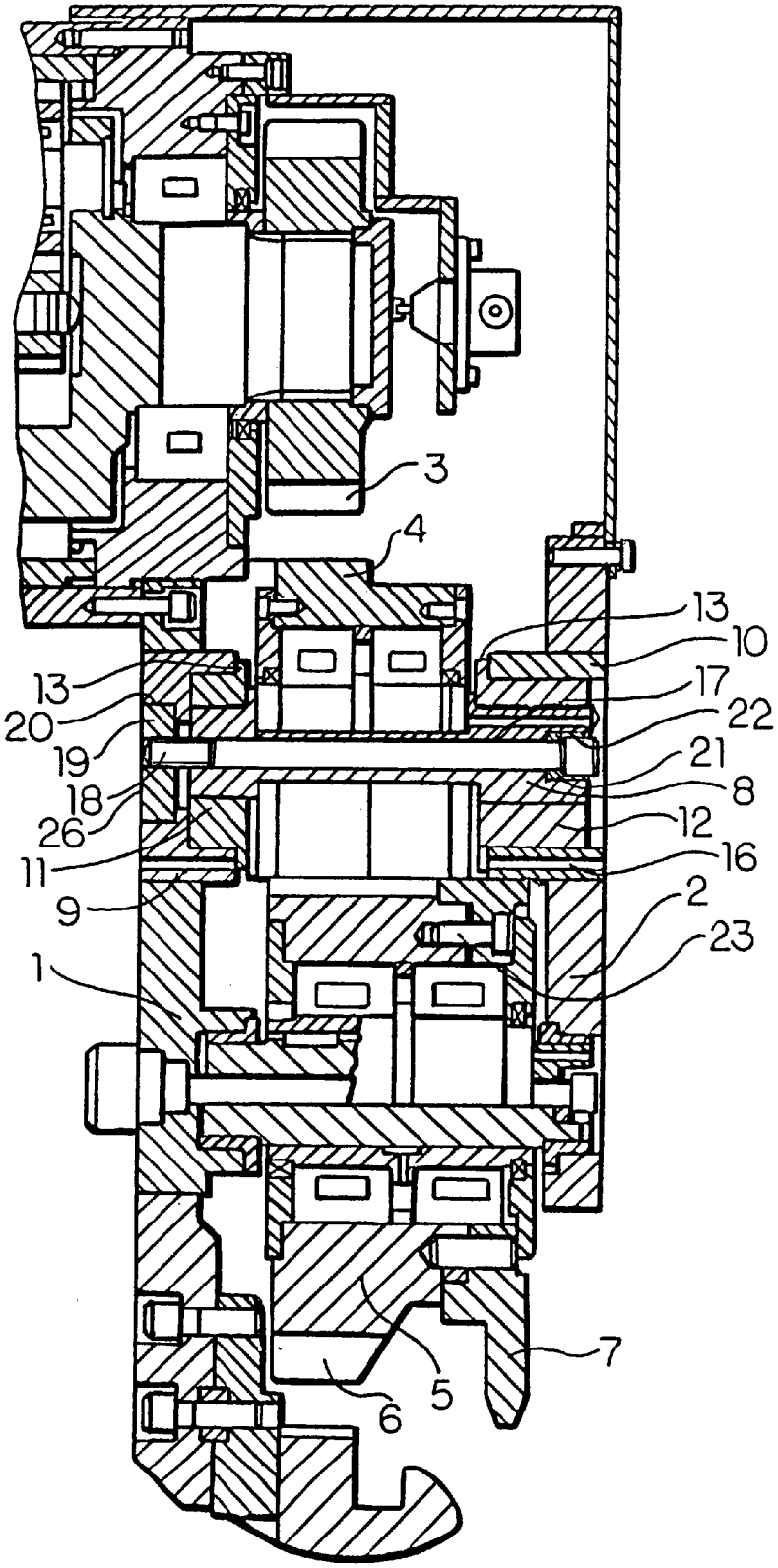
FIG. 1 shows the drive mechanism of the invention in cross-section.
Figure 2:
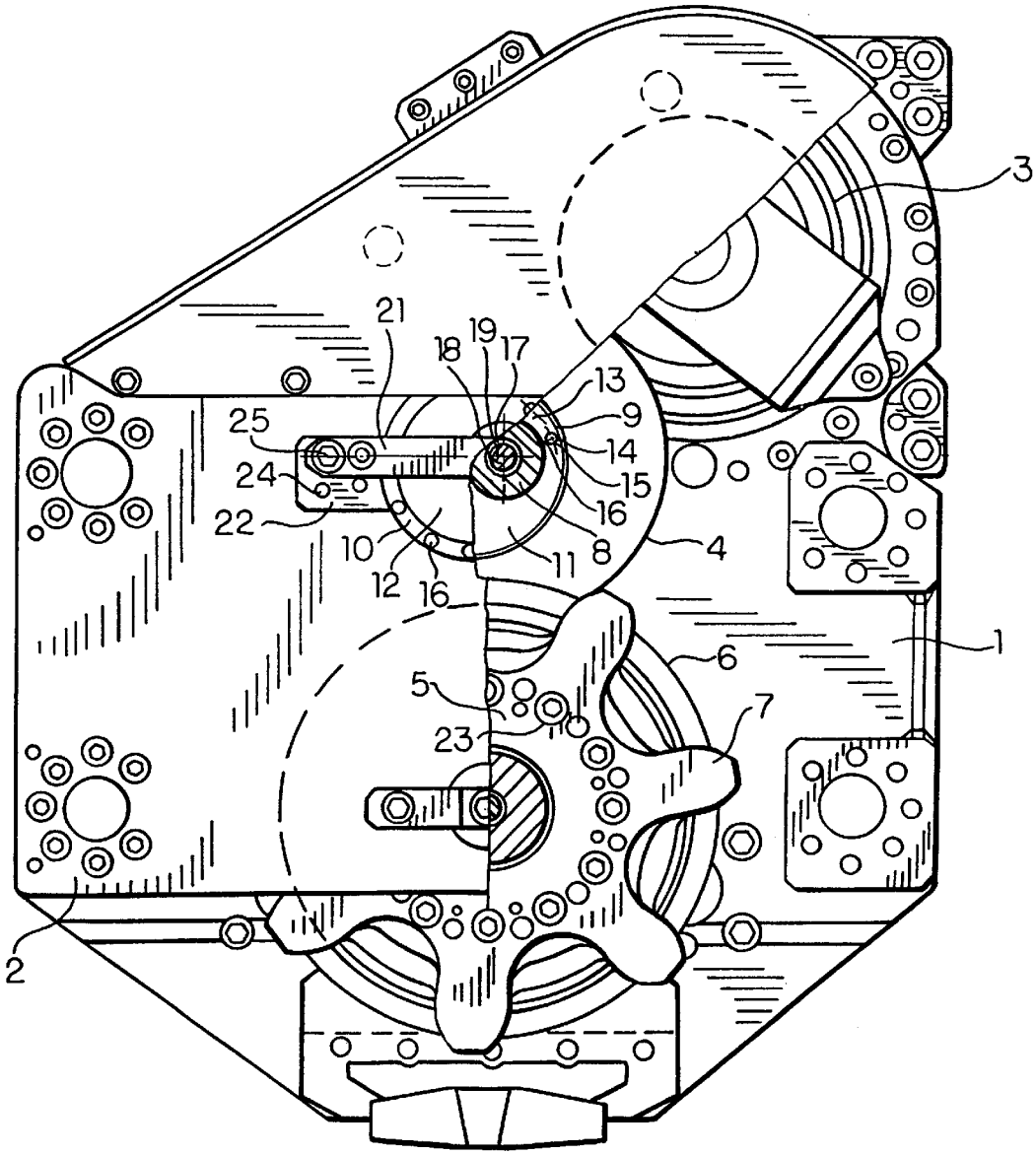
FIG. 2 shows the drive mechanism from the front.
Figure 3:
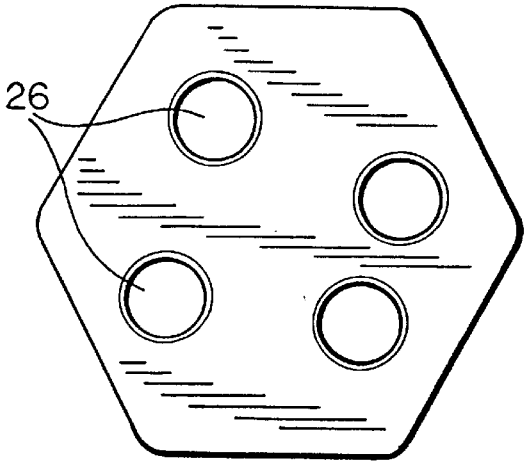
FIG. 3 illustrates a special nut.
Figure 4:
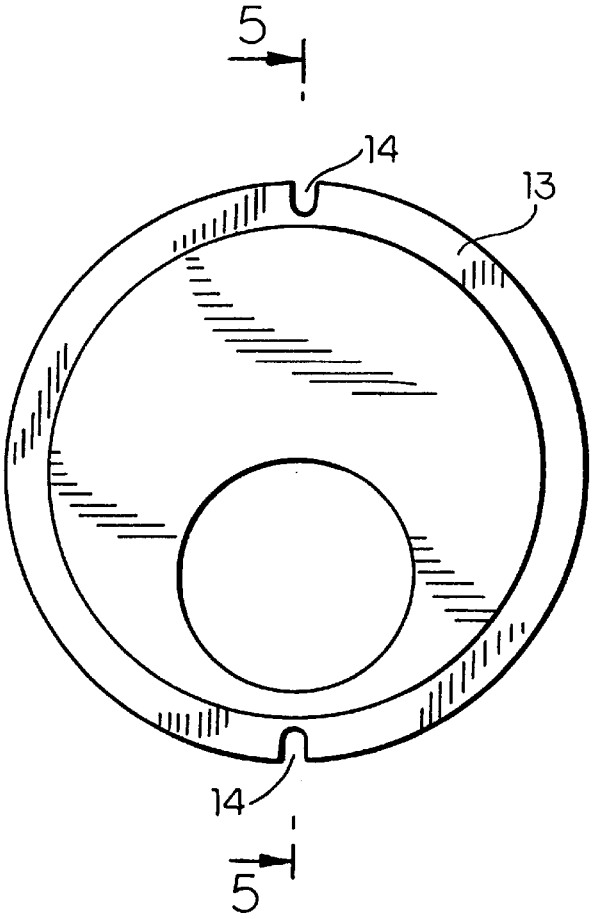
FIG. 4 illustrates the eccentric bush with flange.
Figure 5:
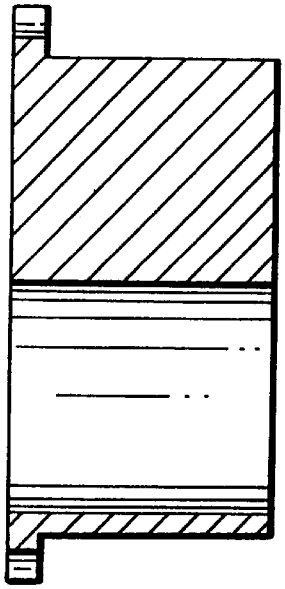
FIG. 5 is a section taken on lines 5—5 in FIG. 4.

The drive mechanism comprises holder 1 having a cover 2. Holder 1 is mounted on the body of the combined cutter loader tractor and on the combined cutter loader sledges. In holder 1 there is an input toothed wheel 3 with modular teeth, which is mounted on the drive shaft of the combined cutter loader tractor.

Toothed wheel 3 co-operates with an indirect or intermediate drive wheel 4 with modular teeth, which conveys the drive to an output drive wheel unit 5. The drive wheel unit 5 comprises tooth wheel 6 with modular teeth, and tooth wheel 7, which directly co-operates with the conveyor ladder or the chain of the conveyor course. Tooth wheel 6 is mounted on the same axis as wheel 7 and they are connected with each other by screws 23. The indirect tooth wheel 4 is mounted on an axle referred to as axis 8. Axis 8 is mounted in holder 1, in hubs 9 and 10, whereas hub 9 being mounted in the housing of holder 1, whereas hub 10 is located on the other side of cover 2 in holder 1. Eccentric bushes 11 and 12 are located in hubs 9 and 10. Eccentric bush 11 is mounted in hub 9, and eccentric bush 12 is mounted in hub 10. On flanges 13 of eccentric bushes 11 and 12 recesses 14 are found, which are located opposite each other. Pins 15 are located in the recesses securing eccentric bushes 11 and 12 against rotation. Pins 15 are mounted in openings 16 in hubs 9 and 10.

In axis 8 of the indirect wheel 4 a longitudinal through opening 17 is formed containing a screw 18 fixing the positioning of axis 8 of the indirect wheel 4, and fixing cover 2 to the housing of holder 1.

Screw 18 is screwed on one side into a hexagonal nut 19, which is mounted in socket 20, in the housing or holder 1 housing. On the other side screw 18 is mounted in a grooved member 21, which is mounted in a rectangular socket 22 in cover 2 of holder 1. Threaded openings 24 are provided in the rectangular socket 22, in which grooved member 21 is fixed by screws 25, to secure axis 8 against rotation during the operating of the drive system. Four threaded through openings 26 are found in nut 19.

If there is a need to change parameters of sliding velocity and of the pulling force of the combined cutter loader it is necessary to exchange and perform the right selection of toothed wheels 3 and 6. Such an exchange of these wheels makes it necessary to change the location of axis 8.

In order to achieve this goal it is necessary to unscrew cover 2 from holder 1 and unscrew screw 18. Then screw 25 fixing grooved member 21 in the rectangular socket 22 is unscrewed. After removing cover 2 the indirect toothed wheel 4 is dismantled together with axis 8, screw 25 being unscrewed and unit 5 of the drive wheel is dismantled, then the toothed wheels 3 and 6 are exchanged. Exchange of toothed wheels 3 and 6 makes it necessary to change the position of axis 8.

For this purpose pins 15 protecting eccentric bushes 11 and 12 against rotation are removed and bushes 11 and 12 are placed into the proper location, and nut 19 is removed from socket 20 and placed in the proper required position, then socket 20 is replaced, and the indirect wheel 4 is mounted with axis 8, pins 15 are fitted, grooved member 21 is fitted in socket 20 using screws 25 and cover 2 on holder 1 is fixed, and screw 18 is screwed in.

What is claimed is:

1. A drive mechanism for a combined cutter loader comprising a holder including a housing adapted for separable connection to a body and to a sledge frame of the combined cutter loader, an input toothed wheel in said holder mounted on a shaft driven by the combined cutter loader when the housing is connected to the combined cutter loader, a separable cover on said holder, an output drive unit, an intermediate toothed wheel interconnecting the input toothed wheel and the output drive unit, an axle supporting said intermediate toothed wheel, hubs respectively supported in said housing and, in said cover at opposite ends of said axle, and an eccentric bush secured in each of said hubs and rotatably supporting a respective said end of the axle.

2. A drive mechanism as claimed in claim 1, wherein each said eccentric bush includes a flange having recesses therein, said drive mechanism further comprising pins engaged in said recesses of each said bush and in its respective hub to secure the bush and the hub together in rotation.

3. A drive mechanism as claimed in claim 1, wherein said axle has a longitudinal opening extending axially therethrough, a screw being disposed in said longitudinal opening, said screw having one end received in a groove of a grooved member engaged in a socket secured to said cover, a nut being provided in said holder at an opposite end of the screw, said hub which is supported in said housing having an opening in which said opposite end of the screw is threadably engaged.

4. A drive mechanism as claimed in claim 3, wherein said grooved member and said socket in which it is secured are separable.

5. A drive mechanism as claimed in claim 4, comprising a socket in said housing of said holder securing said nut therein.

6. A drive mechanism as claimed in claim 3, wherein said nut is provided with at least one further opening, said opposite end of said screw being selectively threaded into a respective one of said openings in said nut.

* * * * *